US006877735B2

(12) United States Patent
Fujiwara

(10) Patent No.: US 6,877,735 B2
(45) Date of Patent: Apr. 12, 2005

(54) PAPER SHEET MANAGING DEVICE AND RECORDING SYSTEM

(75) Inventor: Hitoshi Fujiwara, Nagano (JP)

(73) Assignee: F&F Limited (JP)

( * ) Notice: Subject to any disclaimer, the term of this patent is extended or adjusted under 35 U.S.C. 154(b) by 67 days.

(21) Appl. No.: 10/332,901

(22) PCT Filed: Jul. 19, 2001

(86) PCT No.: PCT/JP01/06283

§ 371 (c)(1),
(2), (4) Date: Jun. 2, 2003

(87) PCT Pub. No.: WO02/06144

PCT Pub. Date: Jan. 24, 2002

(65) Prior Publication Data

US 2004/0007807 A1 Jan. 15, 2004

(30) Foreign Application Priority Data

Jul. 19, 2000 (JP) ..... 2000-219056

(51) Int. Cl.[7] ..... B65H 3/52; B65H 3/06
(52) U.S. Cl. ..... 271/117
(58) Field of Search ..... 271/117

(56) References Cited

U.S. PATENT DOCUMENTS

| | | | | | |
|---|---|---|---|---|---|
| 4,515,358 | A | * | 5/1985 | Fukui | 271/122 |
| 5,137,269 | A | | 8/1992 | Yamamoto | |
| 5,259,607 | A | | 11/1993 | Hironori et al. | |
| 5,485,991 | A | * | 1/1996 | Hirano et al. | 271/121 |
| 5,527,026 | A | | 6/1996 | Padget et al. | |
| 2003/0184001 | A1 | * | 10/2003 | Shiohara et al. | 271/109 |

FOREIGN PATENT DOCUMENTS

| | | | | |
|---|---|---|---|---|
| JP | 52-87251 | | 12/1950 | |
| JP | 60-23146 | | 2/1985 | |
| JP | 60-148740 | | 10/1985 | |
| JP | 63-097535 | | 4/1988 | |
| JP | 05-294477 | | 11/1993 | |
| JP | 05-301645 | | 11/1993 | |
| JP | 07-061617 | | 3/1995 | |
| JP | 07-144774 | | 6/1995 | |
| JP | 7-228367 | * | 8/1995 | B65H/3/06 |
| JP | 9-86717 | * | 3/1997 | B65H/5/06 |
| JP | 10-087100 | | 4/1998 | |
| JP | 10-218394 | | 8/1998 | |
| JP | 2000-191157 | | 7/2000 | |

* cited by examiner

*Primary Examiner*—Donald P. Walsh
*Assistant Examiner*—Kenneth W. Bower
(74) *Attorney, Agent, or Firm*—Blank Rome LLP

(57) ABSTRACT

According to the present invention, a paper sheet managing device is provided. The sheet managing device includes a storage part for storing paper sheets and sheet supply means for supplying a paper sheet from the storage part. The sheet supply means comprises a pick up roller extending in a sheet width direction orthogonal to a sheet feeding direction, a drive shaft extending parallel to the pick up roller and rotationally driving the pick up roller and a plurality of power transmitting means for transmitting a power from the drive shaft to the pick up roller. The plurality of power transmitting means is disposed at at least both ends of the pick up roller and each of the plurality of power transmitting means comprises a gear train that links the drive shaft and the pick up roller and an arm that oscillates the pick up roller. The driving shaft includes processing that prevents rotational phase shifts. With this construction, it is possible to realize a slimline, compact paper sheet managing device that can supply paper reliably using a pick up roller with a long effective length and a small diameter. Using the paper sheet managing device, a slimline and compact printer can be realized.

19 Claims, 8 Drawing Sheets

(a)

(b)

PAPER SHEET MANAGING DEVICE AND RECORDING SYSTEM

TECHNICAL FIELD

The present invention relates to a recording system that prints on paper like cut sheets, using a printing mechanism and to a paper sheet managing device that is suited to such recording system.

RELATED ART

In recent years, portable computers such as B5-sized notebook computers and pocket-sized computers like PDAs have become widespread. Such computers can connect to the Internet using a mobile phone or PHS phone and obtain a wide variety of information or send and receive electronic mail (hereinafter "e-mail"). PHS phones and mobile phones that can download various contents and can send and receive e-mail have also been introduced. Trials are also being undertaken into making payments electronically using mobile appliances such as the computers mentioned above or mobile phones.

Since such mobile appliances are put to various uses in this way, it is extremely important for users to be able to easily print out information including e-mail received by such appliances. For this reason, there are demands for extremely slimline card-type printers as one accessory for mobile appliances such as mobile phones.

A slimline card-type printer is more suited to printing onto cut sheets of A6, A7, or A8 size than on a paper roll that is considerably thick. In such printers, a pick up roller is provided to transport the paper sheets set in the storage part towards a printing head. A bottom plate that is pressed by a pressing spring presses the cut sheets (paper sheet) against the pick up roller, so that when the pick up roller rotates, a suitable frictional force is generated between the roller and the paper, resulting in a paper sheet being transported towards the printing head.

However, there are a number of problems that need to be solved in order to realize a slimmer printer that is only 5 mm or so thick. First, in order to reduce the thickness of the printer, every component has to be made more compact, so that in the case of the pick up roller, for example, the diameter of the roller needs to be set at around 2 mm, even though the diameter in a normal printer is around 20 mm. When the diameter of the pick up roller is reduced, the overall structure loses rigidity and becomes flexible, which makes it difficult to maintain precision. Also, since the overall construction is small, slimline printers become more sensitive to minor influences, such as tiny creases and damage to the paper sheets and changes in the properties of the paper due to changes in temperature or humidity, that have hitherto not been problematic. For these reasons, slimline printers have not been very reliable.

Also, for example, when the diameter of the pick up roller is reduced, the contact area between the roller and the sheet becomes small. This makes it difficult to produce sufficient force for feeding the sheet. While it is possible to maintain a sufficient paper feeding force by raising the force (pressure) that presses the sheets onto the pick up roller, raising the pressing force would make it even easier for the pick up roller that lacks rigidity to bend. Raising the pressure is therefore not possible.

As mentioned above, paper is pressed onto the pick up roller by a bottom plate, though to produce a slimline printer, it is difficult to provide sufficient space for housing the bottom plate and pressing spring and such components should preferably be omitted. However, if the paper is not pressed onto the pick up roller, a sufficient force cannot be obtained.

No matter what mechanism is used for pressing the paper against the pick up roller, the low rigidity of the pick up roller means that it is easy for the pick up roller to bend, and even if an improved solution of the mechanism is found, it is fundamentally still difficult to produce a sufficient paper feeding force compared to an ordinary mechanism. Accordingly, printers that use a small-diameter pick up roller are sensitive and are therefore easily affected by creases and damage to the paper and change in the paper quality. In addition, the paper feeding mechanism needs to be precisely manufactured, with it being difficult to maintain such precision for a mechanism having flexible construction owing to the flexible pick up roller mentioned above. This means that when there are creases in a paper sheet being fed, the paper cannot be transported with the correct alignment, which can lead to paper feeding errors.

There is also the problem of motor power. According to a conventional method where sheet is pressed onto the pick up roller, after feeding, a paper sheet is transported by a platen roller, with the pick up roller being rotated by the sheet and becoming a load on the platen. There are cases where a frictional force acts as an opposing load, so that the motor has the dual loads of rotating the platen and rotating the pick up roller. This is to say, the load caused by rotating the pick up roller should be unnecessary once a paper sheet has been fed. Since there are limits on the size of a motor that can be housed in a printer that is around 5 mm thick, increases in the load of the motor that lead to increases in the size of the motor make it difficult to realize such a slimline printer. Accordingly, it is preferable to eliminate the load of the pick up roller after a paper sheet has been fed.

In addition, in a printer that is around 5 mm thick, if sufficient space is to be provided for storing several dozen sheets, the diameter of the pick up roller is around 2 mm. If a bottom plate is not used and instead the pick up roller is moved so as to press the paper against the pick up roller, a mechanism is required for moving the pick up roller over a sufficiently wide stroke in the direction of the paper thickness to reliably pick up every paper sheet right up to the final sheet, with such mechanism also having to be housed within the slimline printer.

In this way, in order to realize an extremely slimline printer that is only around 5 mm thick, a number of problems regarding the pick up roller remain to be solved. Accordingly, it is an object of the present invention to provide a recording apparatus that solves these problems and can reliably feed paper by having suitable contact made by the pick up roller and the paper sheet. It is another object of the present invention to provide an extremely slimline recording system, such as an apparatus that is around 5 mm thick, that can be used as an accessory of a mobile appliance, such as a mobile phone. It is yet another object of the present invention to provide a recording system with high print quality in spite of being slimline and compact.

DISCLOSURE OF THE INVENTION

According to the present invention, a paper sheet managing device is provided. The sheet managing device includes a storage part for storing paper sheets and sheet supply means for supplying a paper sheet from the storage part. The sheet supply means comprises a pick up roller extending in a sheet width direction orthogonal to a sheet feeding direction, a drive shaft extending parallel to the pick up roller and rotationally driving the pick up roller and a plurality of power transmitting means for transmitting a power from the drive shaft to the pick up roller. The plurality of power transmitting means is disposed at at least both ends of the pick up roller and each of the plurality of power transmitting means comprises a gear train that links the drive shaft and the pick up roller and an arm that oscillates the pick up roller. The arm swings about an axis of a gear in the gear train, to a front end of the arm, a rotational axis of the pick up roller is attached so as to a plurality of gears that form at least part of the gear train (wheel train) links between the axis about which the arm swings and the rotational axis of the pick up roller. In addition, the arm includes frictional load generating means that has friction generated in accordance with rotation between the arm and either the even number of gears or the rotational axis of the pick up roller. An irregularly shaped shaft type, such as a part cut in a D shape type, is applied at engaging parts of the driving shaft and the pick up roller that are engaged to the gears so as to prevent shifts in rotational phase.

The present invention also provides a recording system including a print head, sheet feed means for feeding paper sheet under controlling a feeding speed for printing by the print head, and the paper sheet managing device described above.

With the paper sheet managing device of the present invention, when the drive shaft rotates, the pick up roller is rotated via the gear trains of the power transmitting means in a suitable direction for the sheet feeding direction, and the pick up roller is swung so as to contact the paper by the frictional force generating means provided at the ends of the arms that support the pick up roller. When the pick up roller contacts the paper and a sheet feeding force is produced, a reactionary force presses the pick up roller onto the paper since the pick up roller is supported by the arms. This means that the pick up roller is pressed onto the paper by the power transmitting means, thereby producing the required frictional force for feeding the paper between the pick up roller and the sheet, so that paper sheet can be fed to the print head without using a bottom plate or a pressing spring.

In addition, with the sheet supply means or method where the pick up roller is driven by power transmitting means having arm, the pick up roller is moved in the thickness direction of the sheet, which makes it easy to achieve a sufficient stroke in the thickness direction. Accordingly, even though no bottom plate is used, sheets can be reliably fed to the final sheet using a pick up roller with a small diameter. To increase the stroke, it is preferable for the driving gear that is connected to the drive shaft and the driven gear that is connected to the pick up roller not to be directly linked and for one or a plurality of intermediate gears to be used to link these gears. By providing one or more intermediate gears, the swing radius of the rotational axis of the pick up roller can be increased without increasing the diameters of the driving gear and the driven gear.

If the power transmitting means are disposed on the outside of the storage part, the diameter of the intermediate gear can be increased without making the storage part thicker or sacrificing the space for storing paper. Accordingly, a large stroke can be achieved by attaching the arms so as to swing about rotational axes of the intermediate gears. In this case, the intermediate gear and driven gear correspond to the even number of gears that link the center about which the arms swing and the rotational axis of the pick up roller. On the other hand, when the power transmitting means are disposed on the inside of the storage part, increasing the diameter of the intermediate gears results in a decrease in the space in the storage part. However, by having the arms swing about the rotational axis of the driving gear, which is to say, about the drive shaft, a large stroke can be achieved without sacrificing the space of the storage part by providing an even number of intermediate gears, whose diameters are equal to or less than the diameter of the driven gear, on the arms.

In addition, with a sheet supply means or method where the pick up roller is driven by power transmitting means including arms, after paper has been fed by the pick up roller, the pick up roller can be prevented from acting as a load when the paper is transported by a sheet feed means such as a platen roller that is located close to the print head. By setting a sheet feeding speed of the sheet feed means higher than a sheet feeding speed of the sheet supply means, that is the sheet feeding speed of the pick up roller, a sheet feeding force of the pick up roller is not applied onto the paper. As a result, no reactionary force acts so as to press the pick up roller onto the paper and no pressuring force is applied onto the paper by the pick up roller, so that the pick up roller freewheels. This means that once the paper has been fed, the pick up roller does not provide resistance or load when the paper is being transported by the sheet feed means. The load of the sheet feeding means for feeding paper is reduced, so that the motor driving force can be reduced, thereby making it possible to transport paper with an extremely small motor. The thickness of an extremely slimline recording apparatus that includes a motor can therefore be suppressed to around 5 mm.

In this way, using power transmitting means that include arms for supporting the pick up rollers of the sheet feed means solves a number of the aforementioned problems relating to the realization of an extremely slimline paper sheet managing device and recording apparatus or system. In addition, according to the present invention, sufficient force for feeding paper can be produced with a pick up roller with a small diameter (i.e., low contact area) and low rigidity (i.e., flexibility) by increasing the contact area by having the pick up roller come into contact with at least 50% of the paper sheet width. Also, bending is prevented by supporting at least both ends of the pick up roller with the power transmitting means, with the drive shaft being provided parallel to the pick up roller so that the power transmitting means can be disposed at both ends of the pick up roller.

In addition, by using a long pick up roller with a small diameter that is driven at both ends, since the pick up roller itself lacks rigidity, should the rotation of the drive shaft by the power transmitting means at ends move out of synchronization, there will be variations in the sheet feeding force at ends that can cause deviation in the sheet feeding direction and in the pick up roller bending. For this reason, the present invention uses a method where the rotational phase between the drive shaft and the pick up roller is strictly maintained, so that the rotational force compensates the flexible construction, thereby raising the precision. This is to say, irregularly shaped type shafts that are not circular and are D-shaped in cross-section, for example, are provided at parts where the gear trains of the power transmitting means engage the pick up roller and the drive shaft, so that shifts of the rotational phase of all of the gears are strictly prevented. Also, since the plurality of power transmitting means operate with the same phase in any case, even if there are creases in the paper sheet, the paper is squeezed between the pick up roller and the base surface of the storage part, thereby straightening these creases and making it possible to feed the sheet towards the print mechanism with the correct orientation without being affected by such creases.

Accordingly, with the paper sheet managing device of the present invention, the pick up roller is elongated and is supported at at least both ends by power transmitting means equipped with arms, so that a bottom plate can be omitted, a sufficient paper feeding force for feeding paper with the appropriate orientation can be ensured by extending the contact width of the pick up roller that is flexible due to its small diameter, a sufficient stroke can be ensured in the paper thickness direction, and the pick up roller can be prevented from becoming a load when paper is being transported by a sheet feed means such as a platen roller. Therefore, by using a pick up roller with an extremely small diameter of around 2 mm, sufficient space for storing paper can be provided in a slimline paper sheet managing device that is around 5 mm thick, with it being possible to pick up and supply every sheet right up to the final sheet without paper jams occurring. Accordingly, with the present invention, it is possible to provide a paper sheet managing device that is extremely slim overall but can reliably supply paper. This makes it possible to provide a recording system that can be used as an accessory of a mobile appliance such as a mobile phone or can be incorporated into a mobile appliance, with the overall construction being extremely slim and print quality being high.

By providing a shaft bearing that supports the drive shaft at an intermediate position aside from or in addition to both ends of the drive shaft, which is to say, at at least one position inside the storage part, a drive shaft with a small diameter can be prevented from bending. In addition, the power transmitting means that also support the pick up roller may be provided at one or more positions in the intermediate position of the pick up roller aside from or in addition to both ends of the pick up roller, thereby preventing bending and warping in the pick up roller and making it easy to apply pressure.

The present invention includes a paper sheet managing device and recording system where a plurality of sheets of paper can be set directly or using a sheet cassette that stores a plurality of sheets of paper, in the storage parts. In particular, by using a storage part with a size or form whereby a tongue-like underlay that protrudes from a cassette is positioned opposite the pick up roller, it becomes possible to use a sheet cassette with a protruding underlay, so that every sheet of paper can be picked up with the same conditions right up to the final sheet. This means it is possible to provide a paper sheet managing device where every sheet can be reliably fed right up to the final sheet.

Since the paper sheet managing device of the present invention is extremely slim, a plurality of storage parts can be stacked on multiple levels so as to feed different types or sizes of sheets. This is to say, the present invention also includes a paper sheet managing device and a recording system that have a plurality of storage parts and a plurality of sheet supply means that respectively supply sheet from such storage parts. In particular, a paper storing apparatus of the present invention is suited to a multi-tray where a plurality of storage parts are stacked on multiple levels.

BEST MODE FOR CARRYING OUT THE PRESENT INVENTION

Figure 1:
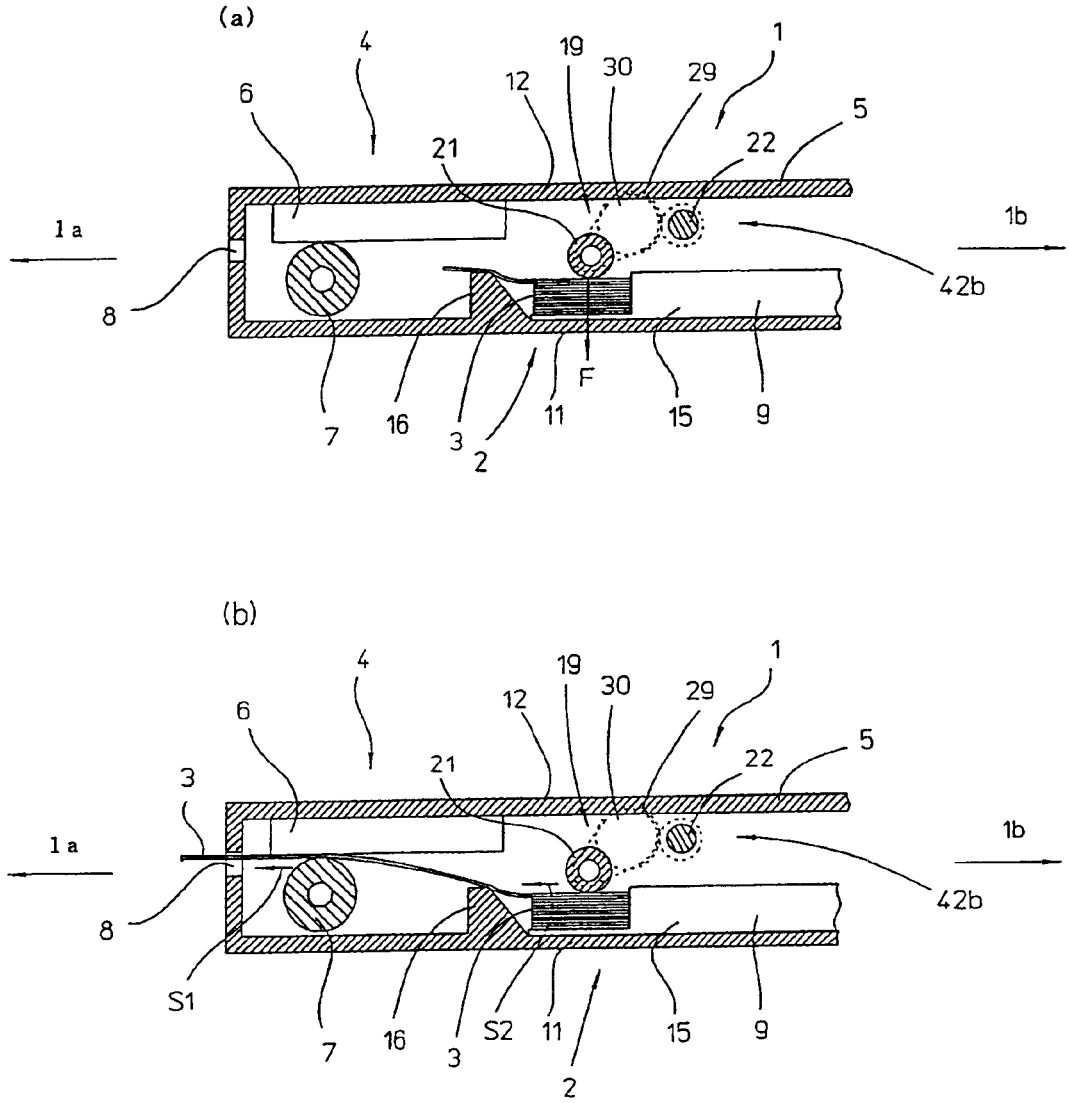
FIG. 1 is cross-sectional views showing the overall construction of a printer according to the present invention.

The following describes several embodiments of the present invention with reference to the enclosed drawings. FIGS. 1(*a*) and 1(*b*) are cross-sectional figures showing the overall construction of a printer 1 according to the present invention. The printer 1 of the present embodiment has a slimline or thin rectangular housing 5 with an overall size of around A7 size (74 mm by 105 mm) and is around 5 mm thick, making it extremely suited to use as a portable printer. A rear end part 1*b* of the housing 5 is a paper sheet managing compartment where a plurality of A8 (52 mm by 74 mm) size thermosensitive cut sheets 3 (thermal sheets or thermal paper) can be stored, and from the sheet stored, one sheet is picked up and fed at a time. Therefore, that compartment is a "paper sheet managing part" or a "paper sheet managing device" 2. A front end part 1*a* is a compartment in which a printing mechanism 4 for printing the thermal sheet 3 fed from the paper sheet managing part 2 is disposed. The printing mechanism 4 includes a thermal head 6 that prints on the thermal sheet 3, and a platen roller 7 that transports the thermal sheet 3 while pressing the thermal sheet 3 onto the thermal head 6. Accordingly, the paper 3 fed from the paper sheet managing part 2 passes between the thermal head 6 and the platen roller 7 with the platen roller 7 as a sheet feed means, is printed upon, and is discharged to the outside from a discharge slot 8 provided in the front end 1*a*.

Figure 2:
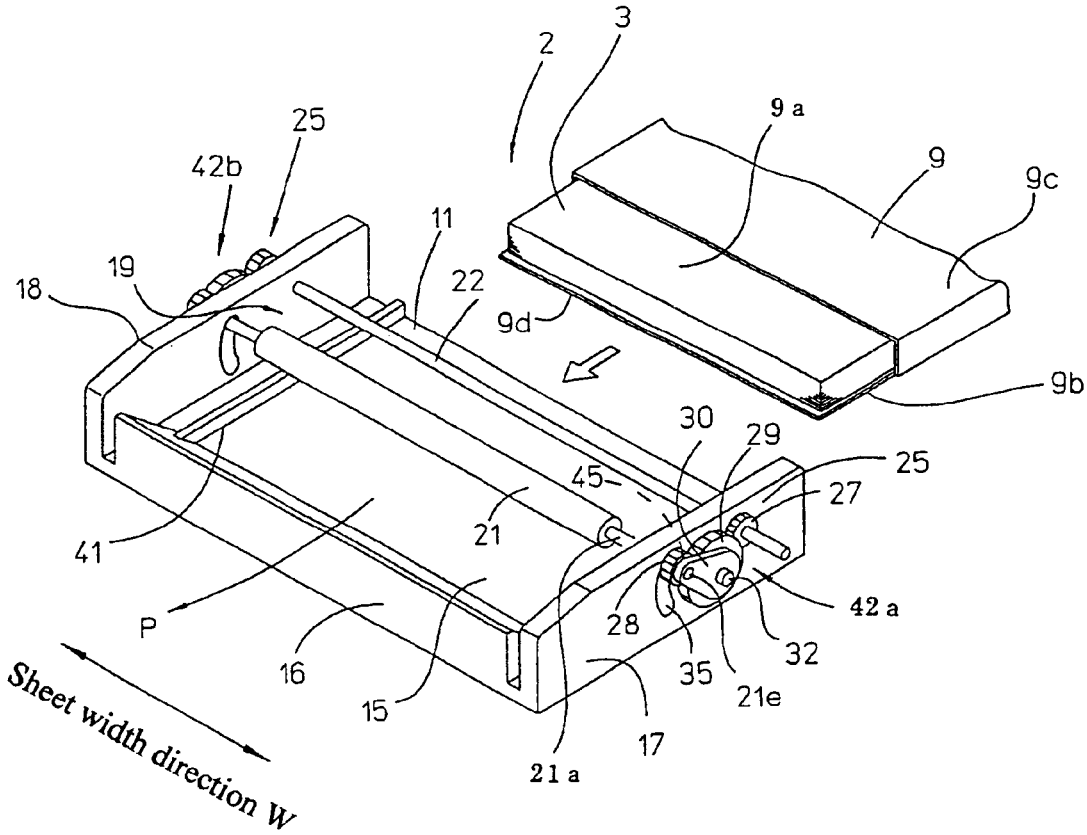
FIG. 2 is a perspective view showing a paper sheet managing device of the printer of the present embodiment, and shows the state before a paper cartridge has been set in the storage part of the paper sheet managing device.
Figure 3:
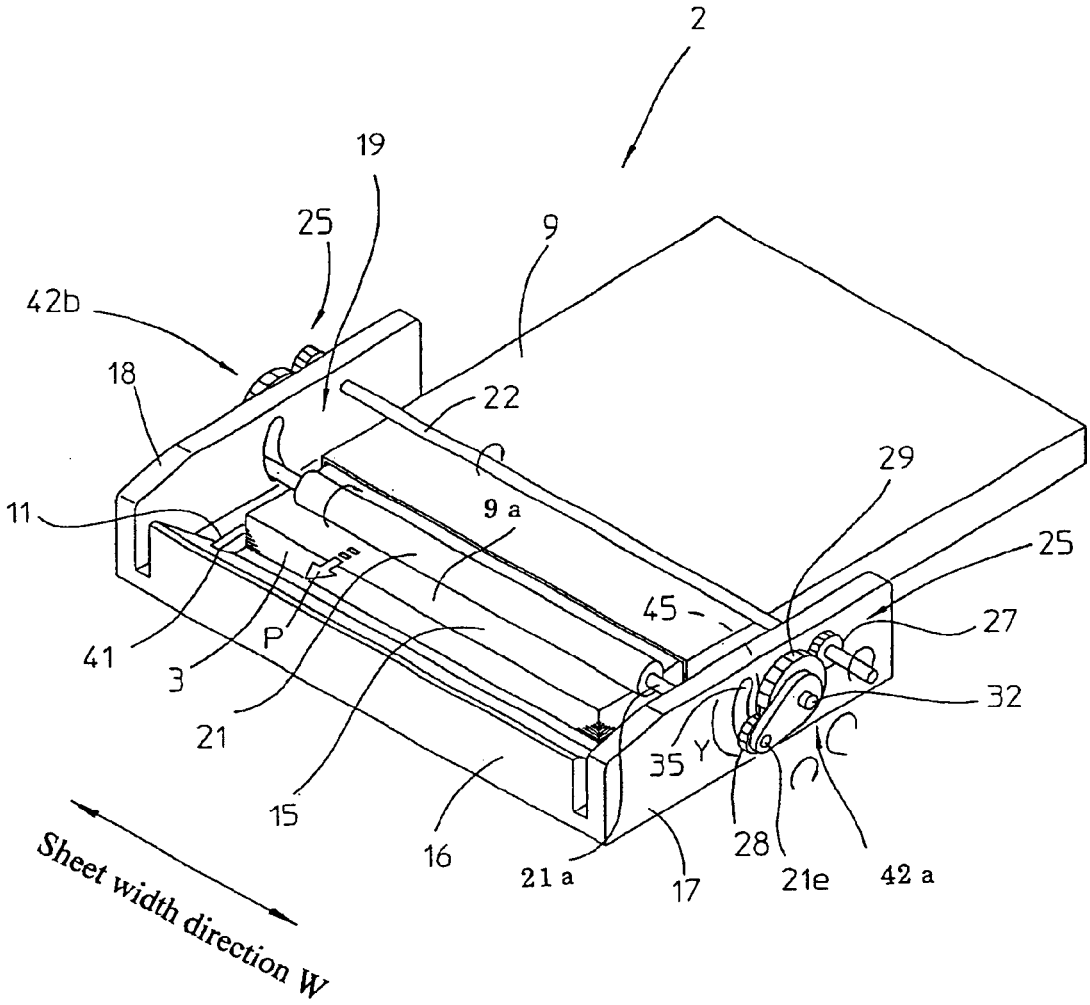
FIG. 3 is a perspective view showing the state once a paper cartridge has been set in the storage part of the paper sheet managing device.

FIG. 2 and FIG. 3 are perspective views that show the overall construction of the paper sheet managing device 2 included in the printer 1. This paper sheet managing device 2 is a sheet storing apparatus or sheet supplying apparatus that holds sheets for the printer 1 and supplies sheets according to orders from the printer 1. FIG. 2 shows the paper sheet managing device 2 in a state before a sheet cassette has been set and FIG. 3 shows the paper sheet managing device 2 in a state after a sheet cassette has been set. The paper sheet managing device 2 includes a storage part 15 that stores the thermal sheets 3 and a sheet supply means 19 that picks up paper sheet stored in the storage part 15 and supplies the paper one sheet at a time. In the printer 1, the housing 5 and the paper sheet managing device 2 are integrally provided, with part of the housing 5 constructing a base 11 of the storage part 15, which supports the thermal sheets 3, and an upper case 12, which covers the storage part 15, so as to protect the thermal sheets 3 from the outside environment. In addition, side walls 17 and 18 extend upwards from the base 11. These side walls 17 and 18 support the mechanism that serves as the sheet supply means 19 and surround the internal space that serves as the storage part 15. In addition, a guide protrusion 41 is formed on the base 11 in the storage part 15 so that a paper sheet cartridge (paper sheet cassette) 9, which stores a plurality of A8-sized (52 mm by 74 mm) thermal sheets 3, can be set in a predetermined state at a predetermined position from the rear end 1*b*.

The sheet supply means 19 of the paper sheet managing device 2 includes a pick up roller 21 that extends from the side wall 17 to the side wall 18, a drive shaft 22 that is disposed parallel to the pick up roller 21, and power transmitting mechanisms 42*a* and 42*b* that are disposed on the outside of the side walls 17 and 18. The pick up roller 21 is disposed on the paper feeding side, which is on the printing mechanism 4 side of the storage part 15, and extends in a sheet width or lateral direction W that is perpendicular to or orthogonal to the sheet feeding direction P. When a sheet cassette 9 has been set in the storage part 15, the pick up roller 21 contacts the uppermost thermal sheet 3 that is exposed at an opening 9*a* of the sheet cassette 9. With the sheet cassette 9 of the present embodiment, a tongue-like member 9*b* extends from a main body 9*c* at a front end 9*d* so as to serve as an underlay for the opening 9*a*, with the final few thermal sheets 3 being held between the pick up roller 21 and the tongue-like member 9*b* and fed. In particular, the final thermal sheet 3 is set so as to slide on the tongue-like member 9*b* that is made of paper or has a similar frictional coefficient as paper, so that the conditions for frictional coefficient around the final sheet is the same as for the other sheets. This means that the sheet 3 can be reliably fed right up to the final sheet without the final sheet being fed together with the sheet above it or the final sheet failing to be picked up.

The pick up roller 21 of the present embodiment has a small diameter so that it can be housed in the slimline printer 1, and for example can be an extremely fine roller with a diameter of around 2 mm. When a thermal sheet 3 that is contacted by the pick up roller 21 strikes a front wall 16 of the storage part 15 due to the rotation of the pick up roller 21, only the very top thermal sheet 3 is separated and is fed at a sheet feeding speed S2, which is proportionate to the rotational speed of the pick up roller 21, towards the printing mechanism 4 positioned at the front end part 1*a*. When the front end of this thermal sheet 3 becomes held between the platen roller 7 and the thermal head 6, the thermal sheet 3 receives a driving force from the platen roller 7 and is transported at a sheet feeding speed S1, which is proportionate to the rotational speed of the platen roller 7, with a desired printing operation being performed by the thermal head 6.

The drive shaft 22 extends in the sheet width direction W parallel with the pick up roller 21, is a member for transmitting a rotational driving force to the pick up roller 21, and is driven by a motor (not shown in the drawing) via a suitable gear mechanism. A driving force is transmitted from the drive shaft 22 to both ends of the pick up roller 21 via the power transmitting mechanisms 42*a* and 42*b*, so that the pick up roller 21 rotates. In the present embodiment, the two power transmitting mechanisms 42*a* and 42*b* are both positioned on the outside of the side walls 17 and 18, which is outside the storage part 15, so that the power transmitting mechanisms 42*a* and 42*b* can be positioned without taking up space in the storage part 15. The power transmitting mechanisms 42*a* and 42*b* have the same construction and exhibit right/left symmetry, so that only the power transmitting mechanism 42*a* is described below as a representative example of the two.

Figure 4:
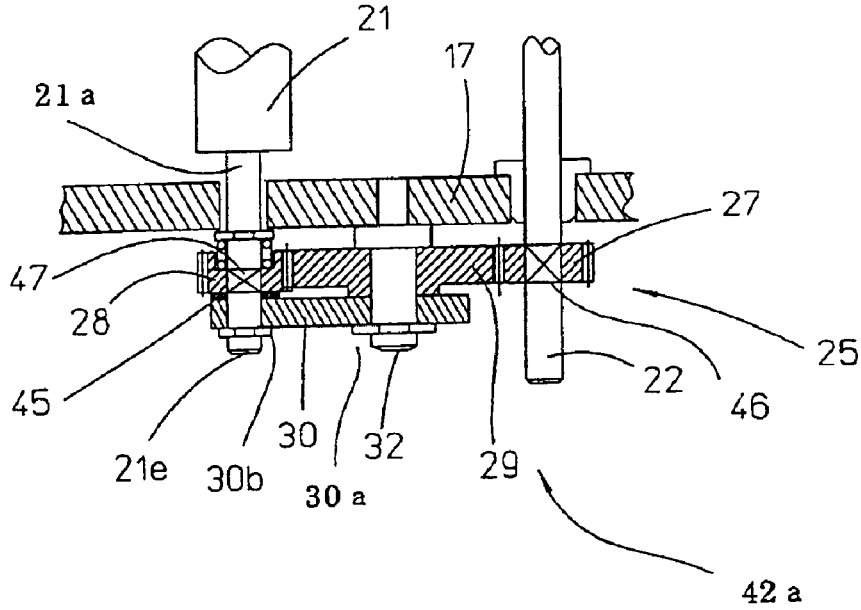
FIG. 4(*a*) is a cross-sectional view showing the overall construction of the power transmitting mechanisms in the present embodiment, and FIG. 4(*b*) is a planar view of the same.
Figure 4:
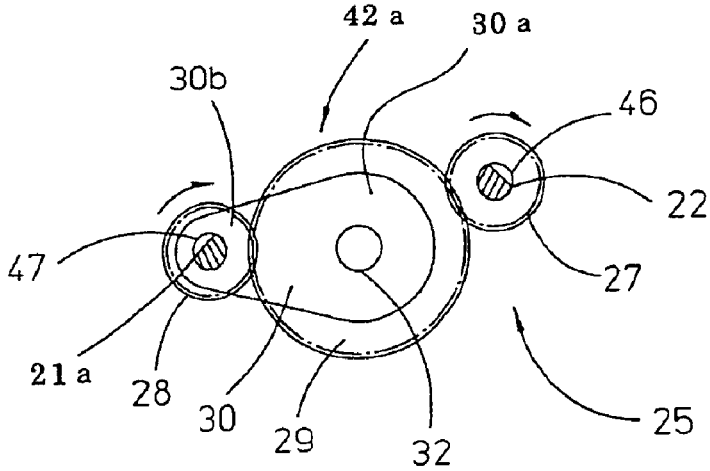

FIGS. 4(*a*) and 4(*b*) are a cross-sectional view and a side elevation showing the construction of the power transmitting mechanism 42*a* in more detail. As shown in FIGS. 2 to 4, the power transmitting mechanism 42*a* is disposed at one end 21*e* of a shaft 21*a* of the pick up roller 21, and includes a gear train (wheel train) 25 that links the drive shaft 22 and the pick up roller 21, an arm 30 that swings the pick up roller 21, and felt 45 as a frictional force generating means for generating a frictional force between the arm 30 and axis 21*a* of the pick up roller 21 when the pick up roller 21 rotates.

The gear train 25 includes a driving gear 27 that is linked to and driven by the drive shaft 22, a passive or driven gear 28 that is linked to the roller shaft 21*a* of the pick up roller 21 and drives the pick up roller 21, and a single intermediate gear 29 that links the driving gear 27 and the driven gear 28. The drive shaft 22 and the roller shaft 21*a* of the pick up roller 21 both pass through the side walls 17 and 18 of the base 11 and protrude to the outside of the storage part 15, with the protruding parts 46 and 47 being fixed to the gears 27 and 28 respectively. On the other hand, the intermediate gear 29 rotates about a shaft and axis 32 that is attached to the first side wall 17, with one end 30*a* of the arm 30 being attached to this shaft 32 so that the arm 30 is able to swing around the axis 32.

Accordingly, the arm 30 swings about the shaft and axis 32 of the intermediate gear 29 that forms part of the gear train 25. The other end 30*b* of the arm 30 is attached to the roller shaft and axis 21*a* of the pick up roller 21. As a result, in the printer 1 of the present embodiment, the axis 32 of the arm 30 and the rotational axis 21*a* of the pick up roller 21 are linked by two gears (i.e., an even number of gears), which are the intermediate gear 29 and the driven gear 28. A part 46 of the drive shaft 22 where the driving gear 27 is attached (i.e. a gear-engaging part of the drive shaft 22) and a part 47 of the shaft 21*a* of the pick up roller where the driven gear 28 is attached (i.e. a gear-engaging part of the pick up roller 21) are irregularly or complementally shaped shaft parts that have been cut in D-shapes as shown in FIG. 4(*b*). This means that these gears 27 and 28 can be respectively fixed to the shafts 22 and 21*a* without slipping, which completely prevents rotational phase shifts of the gears 27 and 28 at these parts 46 and 47, so that these parts 46 and 47 make it possible to move the gears with precise synchronization.

As shown in FIG. 4(*a*), felt 45 that generates a suitable frictional force when the pick up roller 21 rotates is provided in between the driven gear 28 and the arm 30 at the end 30*b* of the arm 30 that supports the pick up roller 21. This means that the rotational force of the pick up roller 21 is used as a force for swinging the arm 30 about the axis 32. The arm 30 is swung by the rotation of the pick up roller 21 so that the pick up roller 21 too can be swung. In the present embodiment, in view of the thickness of the storage part 15, a curved guide channel 35 is formed in the side walls 17 and 18 so that the pick up roller 21 can swing through a predetermined stroke in this thickness direction.

Figure 5:
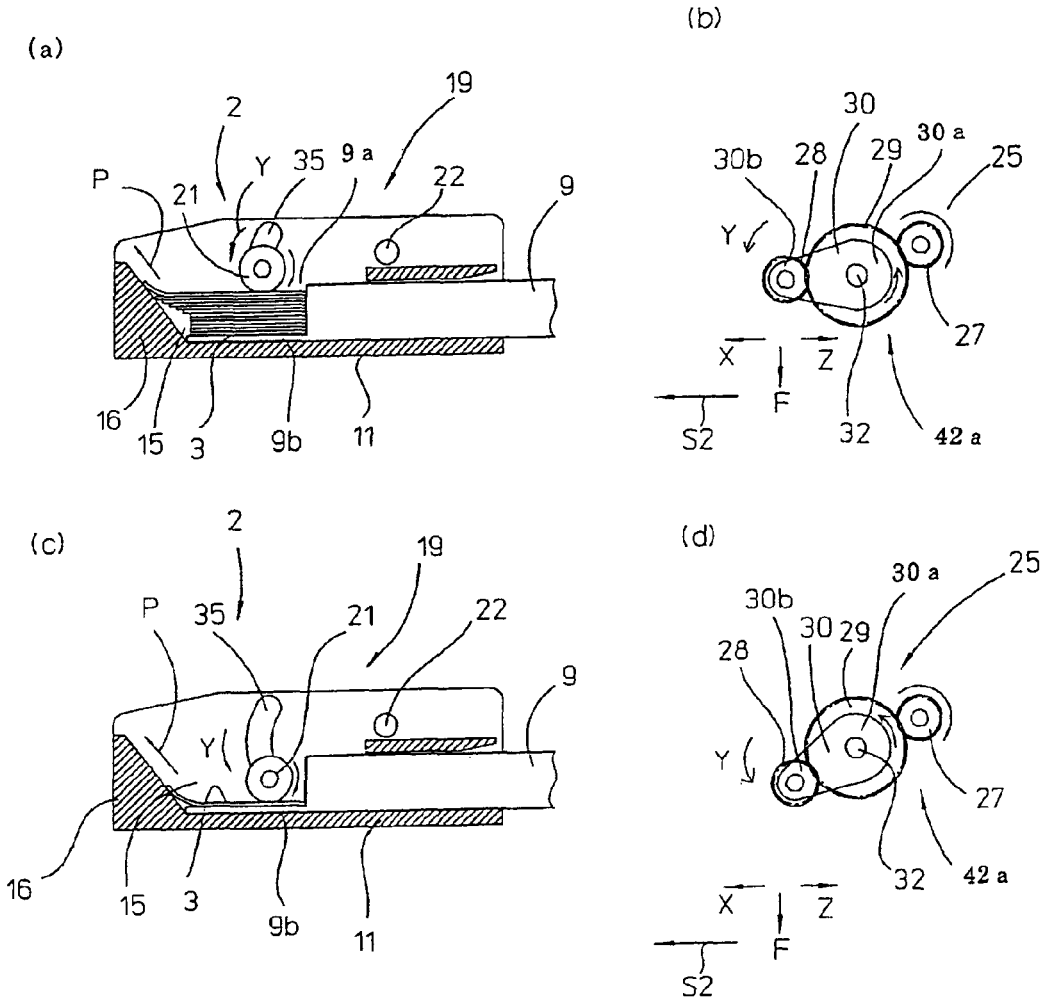
FIG. 5 shows the operation of the power transmitting mechanisms of the present embodiment and the movement of the pick up roller.

FIGS. 5 show how a thermal sheet 3 is supplied by driving the pick up roller 21 via the power transmitting mechanism 42*a* of the present example. As shown in FIGS. 5(*a*) and 5(*b*), when the drive shaft 22 is driven in the clockwise direction, the driving gear 27 rotates in the clockwise direction, the intermediate gear 29 rotates in the anticlockwise direction, and the driven gear 28 rotates in the clockwise direction. The felt 45 that generates a frictional force is held between the driven gear 28 and the arm 30, so that a force Y that swings the pick up roller end 30*b* of the arm 30 in the anticlockwise direction is generated. The other end 30*a* of the arm 30 that is attached to common axis 32 with the intermediate gear 29 to pivot in the anticlockwise direction around the axis 32. Accordingly, the pick up roller end 30*b* of the arm 30 rotates in the anticlockwise direction, which moves the pick up roller 21 in the direction of the thermal sheets 3.

When the pick up roller 21 comes into contact with the thermal sheets 3, the pick up roller 21 is rotationally driven in the clockwise direction, so that a force X acts so as to feed the thermal sheet 3 with which the pick up roller 21 is in contact in the sheet feeding direction P. On the other hand, a reactionary force Z to the force X acts on the pick up roller 21 itself. The pick up roller 21 is supported by the arm 30 so as to be able to swing about the axis 32, so that the reactionary force Z acts so as to further rotate the arm 30 in the anticlockwise direction and as a result a force F that presses the pick up roller 21 in the direction of the thermal sheets 3 is produced. In the sheet supply means 19 of the present example, when the drive shaft 22 is driven by a motor, the pick up roller 21 rotates in the sheet feeding direction and the arm 30 moves in a direction that presses the pick up roller 21 onto the thermal sheets 3. When the feeding of a paper sheet commences by the pick up roller 21, the reactionary force acts so as to pull the pick up roller 21 onto the thermal sheets 3. As a result, the pick up roller 21 can be strongly pressed onto the thermal sheets 3, and a sufficient frictional force for feeding a paper sheet is produced between the pick up roller 21 and the thermal sheet 3. Accordingly, in the printer 1 of the present embodiment, a force that presses the pick up roller 21 itself onto the thermal sheets 3 acts as a reaction to the rotational movement of the pick up roller 21, so that the pick up roller 21 can reliably feed thermal sheets 3 towards the printing mechanism 4 even if no bottom plate or pressing plate is used.

Also, as shown in FIGS. 5(*c*) and 5(*d*), in the printer 1, even if there are only a few thermal sheets 3 left, the rotation of the pick up roller 21 results in the pick up roller end 30*b* of the arm 30 being rotated in the direction of the thermal sheets 3 by the frictional load generating means 45 that uses the felt, so that the pick up roller 21 comes into contact with the thermal sheets 3. When the pick up roller 21 comes into contact with the thermal sheets 3 and the force X that moves a thermal sheet 3 is generated, the reactionary force Z to this force X presses the pick up roller 21 against the thermal sheets 3 as described above. This means that the thermal sheets 3 are always pressed with a suitable force by the roller 21. As a result, regardless of the number of cut sheets 3 that are held in the sheet cassette 9, the pick up roller 21 can always press the thermal sheets 3 so as to produce the required frictional force for feeding sheets, and the cut sheets 3 can always be fed towards the printing mechanism 4.

In this way, with the sheet supply means 19 of the present embodiment, the pick up roller 21 is supported by the power transmitting mechanisms 42*a* and 42*b*, which include the arms 30 and transmit the driving force to the pick up roller 21, so that the pick up roller 21 can be reliably pressed onto the thermal sheets 3 without using a bottom plate or a pressing spring. Accordingly, no space is required for housing a bottom plate or a pressing spring, so that the approximately 5 mm thickness of the housing 5 of the extremely slimline printer 1 can be effectively used for storing the thermal sheets 3. In addition, by rotating the pick up roller 21, the arms 30 are pivoted in the direction of the paper, so that every thermal sheet 3 rights up to the final sheet can be reliably picked up.

In the present embodiment, the power transmitting mechanisms 42*a* and 42*b* are disposed on the outside of the storage part 15, so that intermediate gears 29 with a large diameter can be used without sacrificing the internal storage space of the storage part 15. Accordingly, a distance can be provided between the drive shaft 22 and the pick up roller 21, making it possible to attach arms 30 that have a large rotational radius and can move through a large stroke in the thickness direction of the storage part 15. This means that an extremely fine pick up roller 21 with a diameter of around 2 mm can be used and around 3 mm in a printer 1 with a thickness of around 5 mm can be set as the storage space 15 for the thermal sheets 3, which makes it possible to hold several dozen sheets, with it also being possible to reliably feed every thermal sheet 3 right up to the final sheet held in the storage space 15.

In addition, the paper storage part 15 has a suitable size for storing the thermal sheets 3 in the sheet cassette 9 whose tongue-like member 9*b* extends or protrudes outward in the sheet feeding direction. This means that by setting the sheet cassette 9 that as described above has the tongue-like member 9*b* with a similar frictional coefficient as the sheet, it is further ensured that every thermal sheet 3 right up to the final sheet can be effectively used.

The power transmitting mechanisms 42*a* and 42*b* that use the arms 30 transmit the driving force to the pick up roller 21, and the reactionary force Z to the paper feeding force X of the pick up roller 21 is used to obtain the pressing force F that presses the pick up roller 21 on the thermal sheets 3, thereby producing the frictional force required to feed the sheets. This means that when the sheet feeding force X is not present, there is no reactionary force Z and consequently no pressing force F. If the sheet feeding speed S1 of the platen roller 7 that is the sheet feed means of the printer 1 is set faster than the sheet feeding speed S2 of the paper sheet managing device 2, the thermal sheet 3 that is pulled by the platen roller 7 is not subjected to the sheet feeding force X, so that there is no reactionary force Z and consequently no pressing force F. Accordingly, in the paper sheet managing device 2 of the present embodiment, as shown in FIG. 1(*b*) when the thermal sheet 3 that has been supplied by the pick up roller 21 is transported or fed by the platen roller 7, the pick up roller 21 freewheels on the surface of the thermal sheet 3 and so hardly produces any friction. This means that when a thermal sheet 3 is transported by the platen roller 7, the thermal sheet 3 is not pulled by the pick up roller 21, so that it is possible to substantially or entirely prevent a load from being created by the pick up roller 21 when a thermal sheet 3 is being transported by the platen roller 7. Using this paper sheet managing device 2 therefore makes it possible to reduce the paper transportation load of the platen roller 7, so that compared to conventional apparatuses, a motor with less torque can be used as the driving motor.

A motor that generates low torque is compact, which makes it possible to house a motor with a suitable size in an extremely slimline printer 1 such as that of the present embodiment whose thickness is around 5 mm. By reducing the torque, it is also possible to reduce the power consumption of the motor. When a battery is included in the printer 1, the battery can also be miniaturized, so that a printer that includes a battery can also be compactly produced. Alternatively, a large increase can be made in battery life, which makes it possible to provide a printer that is highly suited to mobile use.

With the printer 1 of the present example, the force F that presses the pick up roller 21 on a cut sheet 3 can be suppressed when the cut sheet 3 is being transported by the platen roller 7, so that problems such as the surface of the cut sheet 3 becoming shiny ("sheen") can be avoided. This phenomenon occurs when a thermal sheet 3 is pulled faster than the sheet feeding speed of the pick up roller 21 with the pick up roller 21 continuously applying pressure to the thermal sheet 3. On the other hand, in the printer 1, when the thermal sheet 3 is pulled faster than the sheet feeding speed of the pick up roller 21, no pressing force F is generated, thereby suppressing the above phenomenon. This means that it is possible to provide a printer capable of high quality print output using the thermal sheets 3.

In this way, with the sheet supply means 19 of the present example in which the pick up roller 21 is supported by the arms 30, enough space for storing sheets can be provided in a slimline space, every sheet right up to the final sheet can be reliably fed, and the motor can be miniaturized, which makes this sheet supply means 19 very suited to a slimline printer 1. The contact part is elongated in the sheet width direction W, which increases the contact area and makes it possible to produce sufficient force for feeding paper even with a small pick up roller 21. In addition, both ends 21*e* of the pick up roller 21 are supported by the power transmitting mechanisms 42*a* and 42*b* which prevents bending and warping, so that the pick up roller 21 can be made an extremely fine with a diameter of around 2 mm.

This is to say, as shown in FIGS. 2 and 3, the pick up roller 21 extends almost completely across the sheet width direction W of the cut sheets 3, so that the pick up roller 21 contacts the entire sheet width of the cut sheets 3. Accordingly, a pick up roller 21 with a small diameter has a sufficient contact surface area with the thermal sheet 3, and the desired sheet feeding force can be obtained without pressing the pick up roller 21 against the thermal sheet 3 with such a strong pressing force. The pressing force of the pick up roller 21 can therefore be minimized so as to suppress the bending and warping of the small-diameter pick up roller 21, with a sufficient paper feeding force still being produced.

By ensuring that there is sufficient area for contact in the sheet width direction W, it is easy to apply force evenly to the entire thermal sheet 3. This means that it is possible to feed the thermal sheet 3 correctly in the predetermined sheet feeding direction P, and that paper jams where the sheet feeding direction W of the thermal sheet 3 is skewed can be prevented. In particular, in a slimline printer 1, there is very little space for the sheet feeding path, etc., so that it is important to feed paper sheet with the correct orientation. Extending the effective length of the pick up roller 21 is also effective in feeding paper sheets correctly. Also, a pick up roller 21 with a small diameter like in the present example has flexible structure, and so can easily become bent or warped due to factors such as small undulations in the thermal sheet 3. By increasing the length of the pick up roller 21 that contacts the thermal sheets 3, even if there is some deformation in the pick up roller 21 that results in some parts coming into insufficient contact with the thermal sheets 3, the effect of such parts is minimized, so that thermal sheets 3 can be fed with high reliability.

In a conventional printer, the diameter of the pick up roller is around 20 mm or is even larger, which makes the pick up roller extremely rigid and makes it possible to apply a strong pressing force on the pick up roller. This means that the length of the pick up roller that contacts the sheets may be reduced. Conversely, when this length is increased, there are cases where the sheet feeding direction becomes skewed due to phase shifts such as those described later. However, with the printer 1 of the present embodiment, the pick up roller 21 is extremely slim with a diameter of around 2 mm, so that the above kind of design cannot be used. By increasing the contact area, the pick up roller 21 is lengthened and a sheet feeding force is produced evenly across the entire width of the pick up roller 21, so that the thermal sheets 3 can be fed with the correct orientation even if there is a certain degree of curved, creased in the sheets. This means that it is preferable for the effective length of the pick up roller 21 to be long, and by using a design where the pick up roller 21 comes into contact with at least 50% of the width of the sheet, the thermal sheets 3 can be fed with sufficient force so as to prevent the sheets from becoming skewed.

By using this kind of long pick up roller 21 with a small diameter, thermal sheets 3 can be reliably fed even in a slimline printer 1 that is around 5 mm thick, though to obtain a sufficient paper feeding force, a certain amount of force has to be applied onto the pick up roller 21, which means that a long, flexible pick up roller 21 with a small diameter of around 2 mm is susceptible to the effects of deformations such as bending, warping, and twisting. When the pick up roller 21 deforms, the long effective length makes it easy for the pick up roller 21 to withstand sheet feeding effect due to the deformation, though such deformation reduces the reliability of paper feeding operations.

With the sheet supply means 19, the bottom plate is omitted to save space as described above and the sheet supply means 19 is constructed so that the pick up roller 21 is swung through a sufficiently long stroke by the arms 30. This means that the pick up roller 21 cannot be attached directly to the side walls 17 and 18. For this reason, the power transmitting mechanisms 42*a* and 42*b* that include the arms 30 support both ends 21*e* of the pick up roller 21, and the pick up roller 21 is driven at both ends 21*e* simultaneously. In addition, to reliably drive the pick up roller 21 with both ends in synchronization, a drive shaft 22 that can apply a common driving force to both ends 21*e* is disposed parallel to the pick up roller 21, the engagement of the gears in the power transmitting mechanisms 42*a* and 42*b* are used, and for preventing the rotational phase shift, the irregularly shaped shaft parts 46 and 47 cut into D shapes are provided at the parts of the drive shaft 22 and the pick up roller 21 that engage the driving gear 27 and the driven gear 28 respectively. Accordingly, when the drive shaft 22 is driven, even if the sheet feeding direction may be easy changed by commencing the sheet feeding or by existing creases, both ends 21*e* of the pick up roller 21 can be driven without phase shifts, so that twisting and warping of the pick up roller 21 can be avoided, which makes it possible to reliably supply the paper in the predetermined direction. In addition, by supporting the pick up roller 21 at both ends 21*e*, bending and warping in the pick up roller 21 are prevented while using a structure where the roller can be swung by the arms 30. This means that a reliable paper feeding force can be obtained, and that the sheet feeding direction can be properly maintained.

In this way, the power transmitting mechanisms 42*a* and 42*b* that include the arms 30 both support the extremely long and flexible pick up roller 21 and transmit the rotational force, so that the thermal sheets 3 can be pressed with a sufficient force without bending the pick up roller 21, and a thermal sheet 3 can be reliably fed to the printing mechanism 4 with the proper orientation. This means that a small-diameter pick up roller can be used and a bottom plate and pressing spring can be omitted, which makes it easier to reduce the thickness of a printer and makes it possible to hold a sufficient number of sheets 3 even in a slimline printer. Accordingly, the printer 1 of the present example makes it possible to realize an extremely slimline card-type printer whose entire body is around 5 mm thick or is even slimmer. Such a printer can be incorporated in or attached to a mobile appliance such as a mobile phone, so that it is possible to provide an extremely small printer that can be carried together with a mobile appliance.

The printer 1 described above is provided with the intermediate gear 29 that is provided in the gear train 25 of the power transmitting mechanisms 42*a* and 42*b*, with the arms 30 swinging through a wide range and the range of movement (stroke) of the pick up roller 21 in the thickness direction also being wide. To prevent the large-diameter intermediate gears 29 from taking up space in the storage part 15, the power transmitting mechanisms 42*a* and 42*b* are provided on the outside of the storage part 15, and in the present example, on the outsides of the side walls 17 and 18. Accordingly, a large stroke can be ensured, though the roller shaft 21*a* of the pick up roller 21 needs to extend beyond the width of the thermal sheets 3 to the outsides of the side walls 17 and 18. Since the span becomes wide, this makes the pick up roller 21 susceptible to bending. On the other hand, it is also possible to provide the power transmitting mechanisms 42*a* and 42*b* close to the storage part 15 or even inside the storage part 15. An example of such a paper sheet managing device 2 is shown in FIG. 6.

Figure 6:
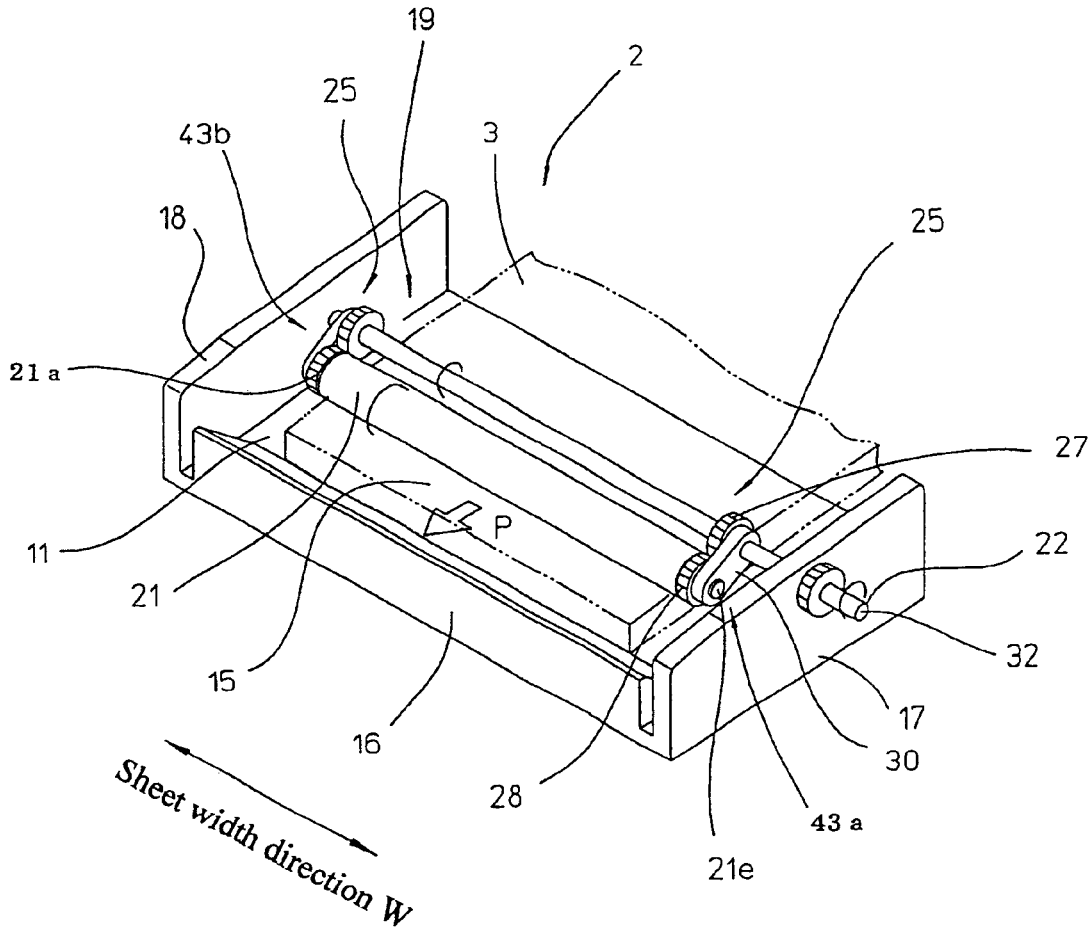
FIG. 6 is a perspective view showing a different example of the paper sheet managing device.

In the paper sheet managing device 2 shown in FIG. 6 also, both ends 21*a* of the pick up roller 21 are supported by power transmitting mechanisms 43*a* and 43*b* that include the arms 30. However, the gear trains 25 of the power transmitting mechanisms 43*a* and 43*b* in this example are composed of driving gears 27 that are connected to the drive shaft 22 and driven gears 28 that are connected to the pick up roller 21, with these gears 27 and 28 engaging one another directly. The arms 30 swing about the center of rotation of the driving gears 27, which is the drive shaft 22, with both ends 21*e* of the pick up roller 21 being supported by the arms 30 so that the pick up roller 21 can be swung about the drive shaft 22. Accordingly, two gears (an even number of gears), which are the driving gear 27 and the driven gear 28, link a shaft 32 about which the arms 30 swing and the rotational axis 21*a* of the pick up roller 21.

The power transmitting mechanisms 43*a* and 43*b* of the present example are also equipped with a frictional force generating means, such as felt, between the driven gears 28 and the pick up roller-side of the arms 30, so that when the pick up roller 21 is driven, the same action is produced as with the power transmitting mechanisms 42*a* and 42*b* described above. This is to say, when looking at the power transmitting mechanism 43*a* from the side, when the drive shaft 22 is rotationally driven in the anticlockwise direction, the pick up roller 21 is rotated in a clockwise direction, which is the sheet feeding direction, by the gear train 25 of the power transmitting mechanism 43*a*. When the pick up roller 21 rotates in the clockwise direction, a moment that swings the pick up roller-side of the arm 30 in the anticlockwise direction is generated. With the power transmitting mechanism 43*a* of the printer 1 of the present example, the drive shaft 22, which is the center of rotation of the arms 30, also rotates in the anticlockwise direction in which the arms 30 swing, so that the moment that is generated by the frictional load generating means swings the arms 30 in the direction that has the pick up roller 21 contact the thermal sheets 3. When the pick up roller 21 has come into contact with the thermal sheets 3 and generated a sheet feeding force, the reaction to this force further presses the pick up roller 21 against the thermal sheets 3, so that a stable force is generated. The same operation also happens in the power transmitting mechanism 43*b* on the opposite side.

In the sheet supply means 19 of the paper sheet managing device 2, by disposing the power transmitting mechanisms 43*a* and 43*b* inside the storage part 15, the overall length of the pick up roller 21 is reduced while maintaining the effective length of the pick up roller 21 that contacts the thermal sheets 3. Accordingly, this construction can reduce the amount of bending in the pick up roller 21, and since the power transmitting mechanisms do not need to be disposed on the outsides of the side walls 17 and 18, the constructions at the sides can be simplified. This means that the paper sheet managing device 2 can therefore be made more compact, making it even more suited to a compact slimline printer. With this construction too, irregularly shaped parts that are not circular, such as D-shaped parts or square parts are formed in the drive shaft 22 and the shaft 21*a* of the pick up roller so as to stop the gears from slipping and reliably synchronize the rotation.

Also, the driving gear 27 and the driven gear 28 are directly linked, so that the driving force can be transmitted more reliably. However, if the stroke Y of the arm 30 in the thickness direction is to be increased, the radius of the driving gear 27 needs to be increased, which may take up more space in the storage part 15. In such cases, as shown in FIGS. 7(*a*) and 7(*b*), it is possible to provide a large stroke without increasing the radius of the driving gear 27 by attaching intermediate gears to the arm 30.

Figure 7:
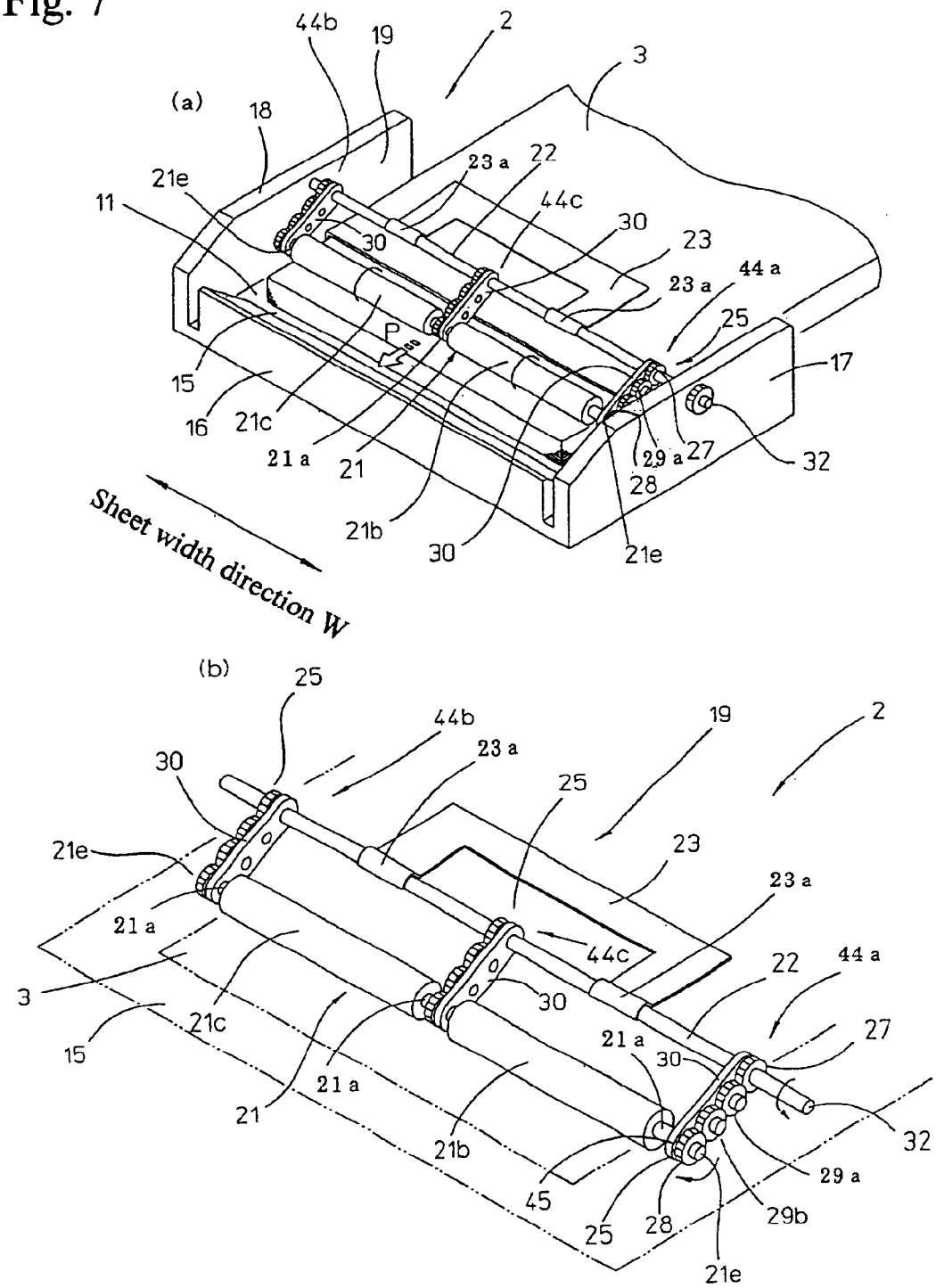
FIG. 7(*a*) is a perspective view showing yet another example of the paper sheet managing device, while FIG. 7(*b*) is a perspective view showing an enlargement of the periphery of the pick up roller of such paper sheet managing device.

FIG. 7(*a*) shows yet another example of a paper sheet managing device 2 according to the present invention, while FIG. 7(*b*) shows the construction of the sheet supply means 19 that has been extracted from FIG. 7(*a*). This sheet supply means 19 also includes a pick up roller 21 and a drive shaft 22 for driving the pick up roller 21. The sheet supply means 19 of present example also includes three power transmitting mechanisms 44*a*, 44*b*, and 44*c* for transmitting the driving force from the drive shaft 22 to the pick up roller 21. Out of these power transmitting mechanisms 44*a*, 44*b*, and 44*c* the power transmitting mechanisms 44*a* and 44*b* are arranged at both ends 21*e* of the pick up roller 21, while the remaining power transmitting mechanism 44*c* is disposed in the middle or intermediate part of the pick up roller 21, with these three power transmitting mechanisms supporting the pick up roller 21 from the drive shaft 22 and transmitting the driving force.

In this paper sheet managing device 2 also, each of the power transmitting mechanisms have the same construction, so that the power transmitting mechanism 44*a* arranged on the right side when looking from the sheet feeding side is described as a representative example. In the same way as the above case, the power transmitting mechanism 44*a* connects the drive shaft 22 and the pick up roller 21 and includes an arm 30 that swings about the drive shaft 22 and a gear train 25 that links the drive shaft 22 and the pick up roller 21. The gear train 25 has two intermediate gears 29*a* and 29*b* disposed between the driving gear 27 and the driven gear 28, with these intermediate gears 29*a* and 29*b* being attached to the arm 30. This means that the axis 32 about with the arm 30 swings and the rotational axis 21*a* of the pick up roller 21 are linked by the driving gear 27, the driven gear 28 and the two intermediate gear 29*a* and 29*b*, a total of four gears (an even number of gears). On a pick up roller-side 30*b* of the arm 30, the power transmitting mechanism 44*a* is provided with a frictional force generating means 45, which uses felt or the like and generates a frictional force when the driven gear 28 rotates. A frictional load generating means can also be provided between the arm 30 and the intermediate gears 29*a* or 29*b*. The power transmitting mechanism 44*a* also operates in the same way as the power transmitting mechanisms 42*a* and 42*b* described above, so that when the drive shaft 22 is driven in the anticlockwise direction, the intermediate gears 29*a* and 29*b* respectively rotate in the clockwise direction and the anticlockwise direction, so that the pick up roller 21 rotates in the clockwise direction and feeds a paper sheet. At this point, the frictional load generating means 45 generates a moment that swings the arm 30 in the anticlockwise direction, which is the same direction as the rotation of the drive shaft 22, so that the pick up roller 21 moves towards and comes into contact with the thermal sheets 3. When the pick up roller 21 comes into contact, a pressing force acts and a thermal sheet 3 can be reliably fed.

In this way, the power transmitting mechanism 44*a* of the present example has two intermediate gears 29*a* and 29*b* in the gear train 25, so that the distance between the drive shaft 22 and the pick up roller 21 can be widened without increasing the radii of the driving gear 27 and the driven gear 28. Accordingly, the stroke of the pick up roller 21 in the thickness direction can be increased without sacrificing space in the thickness direction in the storage part 15. Since the stroke can be increased by providing a plurality of intermediate gears, there is no need to increase the radii of the intermediate gears also. When the construction described in this example is used, space in the storage part 15 hardly be taken up by the intermediate gears, so that there is no need to provide the intermediate gears outside the storage part 15. However, it is preferable for the direction in which the arm 30 swings to match the rotational direction of the drive shaft 22, with it also being necessary for the pick up roller 21 to rotate in the sheet feeding direction, which is to say, in the clockwise direction. In order to maintain these rotational directions, it is necessary to provide two or another even number of intermediate gears 29. The driving gear 27 and the driven gear 28 are provided along with an even number of intermediate gears, so that if the swing direction of the arm 30 is to be oriented towards the thermal sheets 3, the number of gears that link the center 32 and the rotational axis 21*a* of the pick up roller 21 inevitably has to be an even number.

In the space in the storage part 15 between the side walls 17 and 18, the sheet supply means 19 of the present example is also provided with a support bearing 23 that supports the intermediate part of the drive shaft 22. This bearing 23 is C-shaped and has two front tips 23*a*, each of which supports a midpoint of the drive shaft 22. This means that in the present example, the drive shaft 22 is supported at two intermediate points in addition to the two points at the side walls 17 and 18, and so is supported at a total of four points, which makes it extremely difficult for warping and bending to occur. As a result, even if an even finer drive shaft 22 is used, warping and bending can be sufficiently prevented and paper sheets can be fed accurately and reliably. In particular, when large sheets are used in a slimline printer, such as when printing is performed on A6-sized or larger sheets, the length of the drive shaft 22 is increased, which makes it easy for warping and bending to occur. Accordingly, it is preferable to prevent warping and bending by supporting the shaft in the middle as described above.

In addition, in the present example the pick up roller 21 is supported and is driven not just at the two ends but also in the middle by the power transmitting mechanism 44*c*. Accordingly compared to the case where the pick up roller 21 is only supported at both ends, it is more difficult for warping and bending to occur, the pick up roller 21 can be made even smaller, and the space in the paper storage part (storage part) 15 can be used more effectively. By providing a power transmitting mechanism in the middle of the pick up roller 21 and rotationally driving the pick up roller 21 using this mechanism also, it is possible to prevent twisting of the pick up roller 21 and deviations in the paper feeding direction due to skewing of the thermal sheets 3, so that more reliable paper feeding operations can be made. Additionally, when the pick up roller 21 is rotated at one or more intermediate parts in addition to the two ends, it is even more important to maintain the rotational phase of such positions. To do so, gears, which differ from rollers and pulleys in that there is no possibility of slipping, are used as the driving force transmitting mechanisms. In addition, by providing irregularly shaped parts, such as parts cut in D shapes, in the drive shaft 22, the gears can be prevented from slipping on the drive shaft 22, which also prevent phase shifts from occurring for the gears.

In a slimline printer that is compatible with large paper, both the drive shaft 22 and the pick up roller 21 need to be extended, so that it is extremely effective to support the middle of the pick up roller 21 as in the present example so as to prevent bending and warping. Also, in the present example, the intermediate gears 29 are supported by the arms 30, so that these intermediate gears 29 can be provided without sacrificing the space 15 for holding thermal sheets 3. Accordingly, a plurality of power transmitting mechanisms can be provided with a suitable pitch in the longitudinal direction of the pick up roller 21. Also, a gear train 25 does not need to be provided on every arm 30 that supports the pick up roller 21, and bending and warping can be suppressed by providing a plurality of arms 30 without gear trains.

However, to increase the reliability with which paper (thermal sheets) is fed with the proper orientation, it is preferable for a gear train 25 to be provided on every arm 30 and to drive the pick up roller 21. In the sheet supply means 19 of the present embodiment, the rotation of the pick up roller 21 presses the pick up roller 21 onto the sheets under its own force, so that so long as the pick up roller 21 rotates, a force pressing the pick up roller 21 on the paper is generated. Accordingly, the pickup roller 21 presses the paper with an even pressure at all of the positions where the pick up roller 21 contacts the paper, so that paper can be reliably supplied in a slim space within the printer, though if the rotation of the pick up roller 21 becomes unbalanced, the force pressing the pick up roller 21 on the paper also becomes unbalanced, which can cause deviation in the paper feeding direction.

When one or a plurality of power transmitting mechanisms are provided in the intermediate parts of the pick up roller 21, shaft 21*a* of corresponding parts of the pick up roller 21 may be exposed, so that the part of the pick up roller 21 that contacts the paper is divided into a plurality of parts. In the illustrated example, two roller parts 21*b* and 21*c* are provided. If the platen roller 7 is split up, it is not possible to evenly apply pressure to the paper sheet, which causes deterioration in print quality. For the pick up roller 21 however, there is no need to apply pressure to an entire paper sheet, and it is sufficient to apply an even force to sheets within the limit for feeding the paper with the correct orientation. This means that dividing the pick up roller does not cause problems.

As described above, the paper sheet managing device 2 uses a sheet supply means 19 where the pick up roller 21 is rotationally driven via power transmitting mechanisms that include the arms 30, so that the pick up roller 21 can be pressed against the thermal sheets 3 by itself and feed paper one sheet at a time without using a bottom plate, a spring, or the like. By having the arms 30 swing, sufficient space can be provided in the housing of a slimline printer as the storage part 15, so that thermal sheets 3 can be fed one at a time right up to the final sheet. Since the pick up roller 21 is pressed by a reactionary force to the force that feeds sheets, by setting the sheet transporting speed of a mechanism, such as the platen roller 7, that determines the sheet transporting speed near the thermal head 6 higher than the feeding speed of the pick up roller 21, the load of the pick up roller 21 can be easily eradicated, and the load of a motor for sheet feeding operations can be reduced. For these reasons, the sheet supply means 19 of the present example is suited to the realization of a slimline, compact printer 1.

In addition, while it is necessary to use a pick up roller 21 with a small diameter relative to its length in order to realize the printer 1, the drop in the contact area of the pick up roller 21 can be sufficiently compensated for by ensuring that the effective length of the pick up roller 21 is sufficiently long. On the other hand, problems such as bending and warping due to such increases in the effective length are reduced by supporting both ends 21*e* of the pick up roller 21 with the power transmitting mechanisms described above. The pick up roller 21 is subjected to a pressing force that is generated by itself when it rotates, so that by synchronizing the rotation it is easy to ensure that the pressing force is even and protect the construction against problems such as bending and warping. Accordingly, sheet can be reliably fed with no deviation using a flexible pick up roller 21 that has a small diameter.

This means that with the sheet feed means of the present invention, the internal space of a slimline printer or paper sheet managing device can be effectively used, and thermal sheets 3 can be reliably fed by a pick up roller 21 that is flexible due to its small diameter. Accordingly, the present invention realizes a paper sheet managing device that is suited to extremely slimline card-type or note-type printer in the field of independent apparatus, so that it is possible to produce printers whose product image completely differs from conventional printers in terms of portability and compactness. A printer according to the present invention can be produced in an extremely slimline form, which makes it easy to incorporate the printer into a variety of appliances, such as a mobile appliance like a mobile phone or PDA, a desktop or notebook computer, a cash register, or a car navigation system. It is also possible to provide a printer that is attached to such appliances as an accessory.

It should be noted that as described above, it is preferable for the thermal sheets 3 to be set in the storage part 15 inside using a sheet cassette or sheet cartridge 9 provided with a tongue, though a plurality of paper sheets may be set directly in the storage part 15. It is also possible for the printer to be constructed so that a paper cartridge is detachably inserted into the printer main body. While an example of a slimline portable printer has been described above, the present invention is not limited to the small paper sizes such as A6 (105 mm by 148 mm) or below mentioned above, and can be adapted in a paper sheet managing device that uses sheets that are A5 size (148 mm by 210 mm) or larger. The present invention is also not limited to devices that simply output print information received from a host, and may be applied to a great variety of recording apparatuses equipped with functions such as facsimile, photocopying, and camera functions.

Also, while a thermal printer is described as an example, the present invention is adapted to an ink jet printer or laser printer. Thermal printers do not require consumables such as ink or toner, and the printing mechanism can be made extremely small compared to other types of printer, which means that thermal printing is suitable for a slimline printer. Accordingly, the thermal printer is suited to slimline printers with a thickness of around 5 mm according to the present invention. An example of a platen roller is also given above, though with the slimline printer 1, there is the possibility of strength-related problems occurring if a platen roller with a small diameter is used. In this case, it is effective to improve rigidity by replacing the platen roller with a platen that does not rotate and to provide a paper transporting roller (discharge mechanism) as a paper transporting means at a position for pulling thermal sheets that have been printed upon the thermal head 6.

Figure 8:
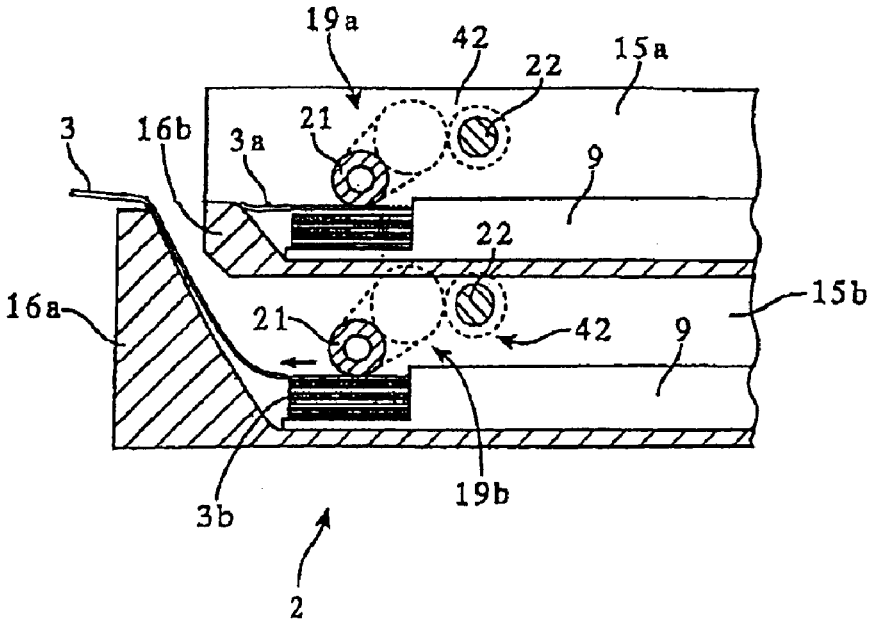
FIG. 8 shows an example of a paper sheet managing device in which a plurality of storage parts are stacked on multiple levels.

Also, since the paper sheet managing device 2 of the present invention can be made extremely slim and thin, it is also possible to stack a plurality of such paper sheet managing devices 2 so as provide a compact multi-tray apparatus in which sheets of various types can be set. An example of such is shown in FIG. 8. In the illustrated multi-tray-type paper sheet managing device 2, two storage parts 15*a* and 15*b* are provided one on top of the other, with sheet supply means 19*a* and 19*b* being respectively provided in these storage parts 15*a* and 15*b*. The sheet supply means 19*a* and 19*b* are each equipped with the pick up roller 21, the drive shaft 22 and the power transmitting mechanisms 42 described above. By selecting either the sheet supply means 19*a* or the sheet supply means 19*b*, one of the paper sheet 3*a* and 3*b* that are stored in the storage parts 15*a* and 15*b* is selected, and one sheet at a time can be separated by the front walls 16*a* and 16*b* and outputted from the same position.

While the paper sheet managing device 2 has a two-level construction, a multi-tray with three or more levels are also possible. By storing sheet of different sizes, different quality paper sheet, sheet of different formats etc. in the respective storage part in this multi-tray-type paper sheet managing device 2, the desired sheet can be selected by merely selecting which sheet supply means 19 is to be driven, with sheets of the selected paper being fed to the printing mechanism 4 and printed upon. While it is also possible for the plurality of storage parts to be arranged on a single plane, the sheet feed means of the present invention has a slimline construction, so that a plurality of trays can be arranged in the same thickness as a single conventional tray. Accordingly, by using the present invention, a printer that can handle a plurality of types of paper can be provided without increasing the thickness of the part that stores the paper.

INDUSTRIAL APPLICABILITY

As described above, the paper sheet managing device of the present invention and the recording system that uses the paper sheet managing device can reliably supply paper in the storage part one sheet at a time to a printing head using a simple construction that uses a pick up roller with a long effective length and small diameter. Accordingly, an extremely slimline and thin paper sheet managing device can be provided, and a card-type or notebook-type recording system with an overall slimline construction that is suited to use with a mobile phone, PDA, etc can also be provided. The present invention is suited to adoption in a wide range of apparatuses that handle sheet, and by arranging storage parts on a plurality of levels, for example, a compact multi-tray apparatus can be provided.

What is claimed is:

1. A paper sheet managing device including a storage part for storing paper sheets and sheet supply means for supplying a paper sheet from the storage part, the sheet supply means comprising:

a pick up roller extending in a sheet width direction orthogonal to a sheet feeding direction;

a drive shaft extending parallel to the pick up roller and rotationally driving the pick up roller; and a plurality of power transmitting means for transmitting a power from the drive shaft to the pick up roller, the plurality of power transmitting means being disposed at at least both ends of the pick up roller and each of the plurality of power transmitting means being comprising:

a gear train that links the drive shaft and the pick up roller;

an arm that swings about an axis of a gear in the gear train, to a front end of the arm, a rotational axis of the pick up roller being attached so as to an even number of gears that form at least part of the gear train links between the axis about which the arm swings and the rotational axis of the pick up roller; and frictional force generating means for generating friction force in accordance with rotation between the arm and either the even number of gears or the rotational axis of the pick up roller, wherein engaging parts of the driving shaft and the pick up roller that are engaged to the gears are irregularly shaped shaft parts and the pick up roller is flexible.

2. A paper sheet managing device according to claim 1, wherein the pick up roller is sized so that the pick up roller contacts with at least 50% of a width of the paper sheets set in the storage part.

3. A paper sheet managing device according to claim 1, wherein the gear train includes a driving gear that is driven by the drive shaft, a driven gear that drives the pick up roller, and at least one intermediate gear that links the driving gear and the driven gear.

4. A paper sheet managing device according to claim 3, wherein the plurality of power transmitting means are disposed on outside of the storage part, the arm swings about an axis of the intermediate gear, and the even numbers of gears are the intermediate gear and the driven gear.

5. A paper sheet managing device according to claim 3, wherein the plurality of power transmitting means are disposed on inside of the storage part, the arm swings about a center of the drive shaft, and the at least one intermediate gear includes an even number of gears that are supported by the arm.

6. A paper sheet managing device according to claim 1, further comprising a shaft bearing that supports the drive shaft at at least one position inside the storage part.

7. A paper sheet managing device according to claim 1, further comprising a plurality of storage parts and a plurality of sheet supply means for supplying the paper sheet from the plurality of storage parts respectively.

8. A paper sheet managing device according to claim 7, wherein the plurality of storage parts are stacked on multiple levels.

9. A paper sheet managing device according to claim 1, wherein in the storage part, a sheet cassette for storing a plurality of paper sheets and having a tongue-like protruding underlay is set.

10. A recording system including a print head, sheet feed means for feeding paper sheet under controlling a feeding speed for printing by the print head, a storage part for storing paper sheets and sheet supply means for supplying the paper sheet from the storage part to the sheet feed means, the sheet supply means comprising:

a pick up roller extending in a sheet width direction orthogonal to a sheet feeding direction;

a drive shaft extending parallel to the pick up roller and rotationally driving the pick up roller; and a plurality of power transmitting means for transmitting a power from the drive shaft to the pick up roller, the plurality of power transmitting means being disposed at at least both ends of the pick up roller and each of the plurality of power transmitting means being comprising:

a gear train that links the drive shaft and the pick up roller;

an arm that swings about an axis of a gear in the gear train, to a front end of the arm, a rotational axis of the pick up roller being attached so as to an even number of gears that form at least part of the gear train links between the axis about which the arm swings and the rotational axis of the pick up roller; and frictional force generating means for generating friction force in accordance with rotation between the arm and either the even number of gears or the rotational axis of the pick up roller, wherein engaging parts of the driving shaft and the pick up roller that are engaged to the gears are irregularly shaped shaft parts and the pick up roller is flexible.

11. A recording system according to claim 10, wherein the pick up roller is sized so that the pick up roller contacts with at least 50% of a width of the paper sheets set in the storage part.

12. A recording system according to claim 10, wherein a feeding speed of the sheet feed means is faster than a feeding speed of the sheet supply means.

13. A recording system according to claim 10, wherein the gear train includes a driving gear that is driven by the drive shaft, a driven gear that drives the pick up roller, and at least one intermediate gear that links the driving gear and the driven gear.

14. A recording system according to claim 13, wherein the plurality of power transmitting means are disposed on outside of the storage part, the arm swings about an axis of the intermediate gear, and the even numbers of gears are the intermediate gear and the driven gear.

15. A recording system according to claim 13, wherein the plurality of power transmitting means are disposed on inside of the storage part, the arm swings about a center of the drive shaft, and the at least one intermediate gear includes an even number of gears that are supported by the arm.

16. A recording system according to claim 10, further comprising a shaft bearing that supports the drive shaft at at least one position inside the storage part.

17. A recording system according to claim 10, further comprising a plurality of storage parts and a plurality of sheet supply means for supplying the paper sheet from the plurality of storage parts respectively.

18. A recording system according to claim 17, wherein the plurality of storage parts are stacked on multiple levels.

19. A recording apparatus according to claim 10, wherein in the storage part, a sheet cassette for storing a plurality of paper sheets and having a tongue-like protruding underlay is set.

* * * * *